United States Patent [19]

Polson

[11] Patent Number: 4,970,834

[45] Date of Patent: Nov. 20, 1990

[54] DETENTION FACILITY

[76] Inventor: Steven R. Polson, 700 NW. 4th Ter., Kansas City, Mo. 64116

[21] Appl. No.: 357,412

[22] Filed: May 26, 1989

[51] Int. Cl.[5] ..... E04H 3/08

[52] U.S. Cl. ..... 52/106

[58] Field of Search ..... 52/106

[56] References Cited

U.S. PATENT DOCUMENTS

| | | | |
|---|---|---|---|
| 229,540 | 7/1880 | Maetzel | 52/106 |
| 244,358 | 7/1881 | Brown et al. . | |
| 353,662 | 12/1886 | Brown | 52/106 |
| 722,789 | 3/1903 | Weary . | |
| 1,611,261 | 12/1926 | Youngblood | 52/106 |
| 1,614,336 | 1/1927 | Youngblood | 52/106 |
| 1,629,371 | 5/1927 | Youngblood | 52/106 |
| 2,219,412 | 10/1940 | Dean | 52/106 |
| 2,248,805 | 7/1941 | Cocken | 52/106 |
| 3,722,152 | 3/1973 | Schlatter | 52/106 |

OTHER PUBLICATIONS

Sweet's Catalog File 2.13 AM pp. 1, 7, 8, 17, 1987 TH455/587.

*Primary Examiner*—John E. Murtagh

*Attorney, Agent, or Firm*—Litman McMahon & Brown

[57] ABSTRACT

A detention facility includes an outer, weather envelope and an inner, detention or security envelope. The facility can include dormitory blocks comprising group living units within the detention envelope and can also include a cell block comprising individual cell units within a separate detention envelope. Environmental control systems for the facility can be placed between the weather and detention envelopes and can include lighting systems and heating, ventilating and air-conditioning systems. The detention envelopes can be constructed of a relatively open, mesh-like material to transmit light and air, and also to facilitate surveillance of inmates within the detention envelopes. The detention facility can include an administrative unit and can be retrofit in an existing light industrial facility.

24 Claims, 2 Drawing Sheets

DETENTION FACILITY

BACKGROUND OF THE INVENTION

1. Field of the Invention

The present invention relates generally to detention facilities, and in particular to such a facility with an outer, weather envelope and an inner, detention envelope.

2. Description of the Prior Art

Detention facilities are used to detain inmates and patients under various circumstances. Examples include persons accused and convicted of crimes, persons requiring protection in an environment with a relatively high degree of security, and persons with disorders and diseases who must be quarantined or segregated from the general population.

Traditional correction and detention facilities include prisons, jails, correction farms and half-way houses. Most of these facilities represent a compromise between security and costs. For example, "maximum security" prisons typically receive criminals who are considered high risk because they might be escape-prone and dangerous to society. Such maximum security facilities tend to include sophisticated security systems and relatively high ratios of guards-to-inmates. They are typically constructed as escape-proof as possible, which generally mandates the use of relatively expensive construction materials and techniques which would be difficult to penetrate or disassemble, e.g. masonry, concrete and steel. All of these features tend to contribute to the relatively high expenses associated with constructing, maintaining and operating maximum security prisons.

At the other end of the spectrum are relatively low-cost and low-security detention techniques. One such technique involves placing a minimal-risk offender under "house arrest". Electronic devices have been devised for attachment to offenders whereby their presence in their own homes can be electronically verified. Although these techniques offer potential savings to taxpayers, the lack of supervision and security renders them unsuitable for many inmates and patients.

Between these extremes exist a wide variety of correctional and detention facilities with various degrees of security and levels of costs. It will be appreciated that security and costs are generally inversely proportional to each other; the more security and supervision the greater the costs (for both construction and operation) and vice versa.

Criminal justice systems in many areas of this country are currently facing a dilemma caused by insufficient resources to adequately meet the demands of growing inmate populations. One factor contributing to this dilemma is the existence of mandatory prison terms for certain offenses, such as drug trafficking and various violent crimes. Court orders mandating reductions in prison overcrowding are also a factor. The influx of refugees and illegal aliens who must be detained pending naturalization or expulsion further contributes to the dilemma.

Faced with such demands, many government entities are finding it necessary to provide additional detention facilities. However construction costs for conventional detention facilities tend to be relatively high, for example, in the range of Sixty Thousand to Seventy-Five Thousand Dollars per inmate. Furthermore, the construction periods typically associated with conventional detention facilities tend to be relatively long due to the complexity of such structures and their security aspects. Lengthy construction periods can further increase the costs associated with interest charges on financing, inflation, etc.

The detention facility of the present invention addresses these problems associated with conventional detention structures.

SUMMARY OF THE INVENTION

In the practice of the present invention, a detention facility is provided which includes an outer, weather envelope and an inner, detention or security envelope. Within the inner envelope the facility can be divided into a number of living units, ranging in size from individual cells accommodating one person each to group dormitories. Lighting and environmental control within the inner envelope are facilitated by enclosing it with relatively open materials which permit the passage of light and air. The facility also facilitates surveillance by permitting visual observation of the inmates through the inner envelope. According to one embodiment of the present invention, costs are minimized by retrofitting the detention facility in an existing structure.

Most parts of the country include numerous metal frame, light-construction buildings which were constructed at relatively low cost per square foot for light manufacturing, warehousing and similar applications. They are often constructed with prefabricated building components and systems to control costs and reduce construction time. Such metal industrial buildings are often available on the resale market at reasonable prices. Yet another advantage is that many of these industrial buildings are located on land zoned for industry and are thus removed from residential areas. Still further, many such industrial buildings include relatively large, open storage or manufacturing areas with office wings connected thereto. In the practice of the present invention the large, open areas can be converted for inmate or patient detention, and the office wings can be converted for administrative functions associated with the operation of the detention facility.

OBJECTS OF THE PRESENT INVENTION

The principal objects of the present invention are to provide a correction and detention facility; to provide such a facility which includes an outer, weather envelope and an inner, security envelope; to provide such a facility which can be retrofitted in an existing, light industrial building; to provide such a facility which provides a relatively high degree of security; to provide such a facility which facilitates surveillance of inmates; to provide such a facility which can be located in areas zoned for industry; and to provide such a facility which is relatively economical and fast to construct, efficient in operation, capable of a long operating life and particularly well adapted for the proposed usage thereof.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

BRIEF DESCRIPTION OF THE DRAWINGS

FIG. 2 fragmentary, top plan view of the

DETAILED DESCRIPTION OF THE PREFERRED EMBODIMENT

I. Background and Environment

Figure 5:
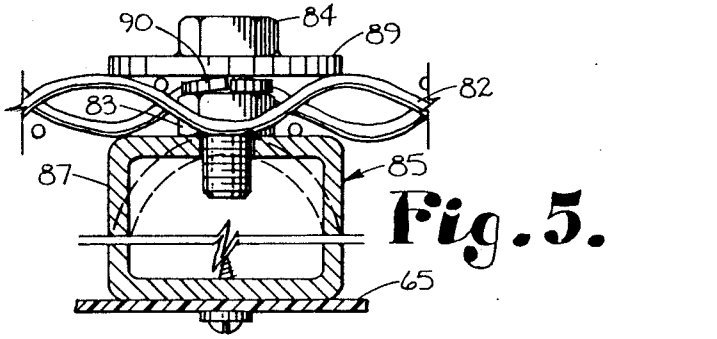
FIG. 5 a fragmentary, vertical, cross-sectional view of the facility taken generally along line 5—5 in FIG. 2.
Figure 2:
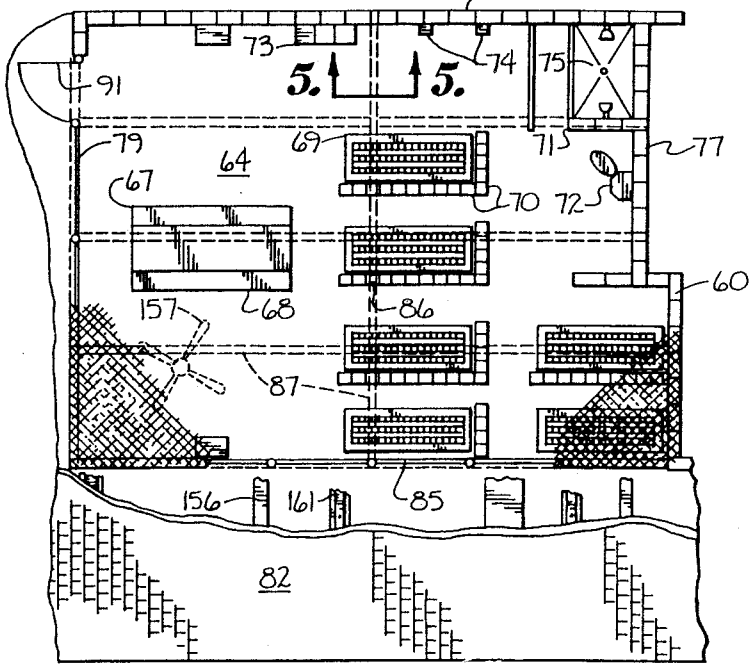

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Referring to the drawings in more detail, the reference numeral 10 generally designates a detention or correction facility embodying the present invention. Without limitation on the generality of useful applications of structures embodying the present invention, a detention facility is disclosed which is adapted to detain inmates and to provide for their general support including feeding, sleeping and personal hygiene. Facilities are also provided for medical treatment and interaction with visitors.

Detention facilities embodying the present invention could also be used for quarantining patients, detaining people in protective custody and detaining people pending completion of naturalization and immigration processes.

The detention facility 10 generally comprises a primary, residential unit 11 and a contiguous, interconnected, secondary administrative unit 12. The residential unit 11 includes an outer, weather envelope 13 and dormitory and cell block inner, detention envelopes 14, 15 enclosing a dormitory block 18 and a cell block 19 respectively. The detention facility 10 further includes an environmental control system 16 for lighting, climatic and related environmental control in the residential and administrative units 11, 12.

II. Residential Unit 11

The residential unit 11 can be contained in a relatively large, open structure or weather envelope 13 with front and back walls 21, 22, opposite side walls 23, 24, a relatively low-sloping gable roof structure 25 defining a longitudinally-extending peak or ridge line 26 and a floor structure 27. Light industrial buildings with this configuration can include steel skeletal frameworks 28 and sheet metal siding and roofing 29. They can also include prefabricated components. Because the construction tends to be relatively light and because a relatively strong steel frame 28 is employed, a relatively large interior volume 30 can be enclosed within the weather envelope 13.

The walls 21–24, the roof structure 25 and the floor structure 27 generally form the weather envelope 13. The interior volume 30 is highest along the longitudinal centerline of the residential unit 11, beneath the roof peak or ridge line 26.

The residential unit 11 includes a first block of support facilities 33 located in a corner formed by the back wall 22 and the side wall 23, which includes a storeroom 34, a vehicular entryway or vestibule (commonly referred to in detention facilities as a "sally port") 35, an intake room 36, an interview room 37, a toilet 38, a storeroom 39 and a stairwell 40. Ingress and egress to the first support facility block 33 are through an overhead door 41 for a vehicle 42 and through an exterior door 43. Ingress and egress between the first support facilities block 33 and the rest of the residential unit 11 is through an interior door 44.

A second support facilities block 48 is provided along the second side wall 24 and can extend between the residential unit front and back walls 21, 22. The second support facilities block 48 can include a food storeroom 49, a kitchen 50, a multi-use (e.g. exercise) room 51, a laundry room 52, a janitorial room 53 and a storeroom 54. The rooms within the second support facilities block 48 are accessible through interior doors 44.

III. Dormitory Envelope 14

Figure 1:
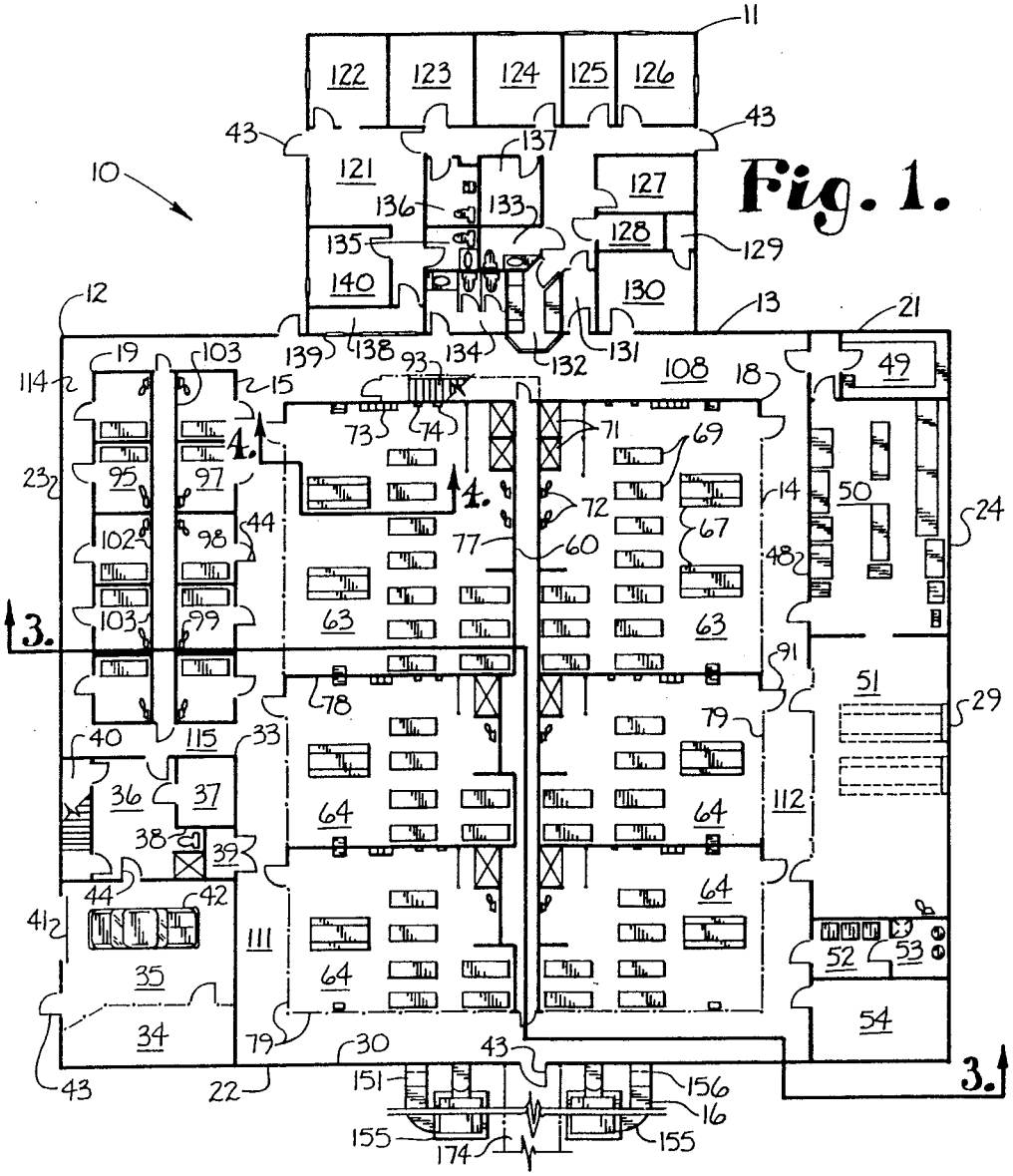
FIG. 1 a top plan view of a detention/correctional facility present invention.

The dormitory detention envelope 14 encloses a plurality of group occupancy living units extending transversely outwardly from both sides of a central utility core 60 which extends generally along the longitudinal centerline of the residential unit 11. The utility core 60 is accessible through interior doors 44 located at each end thereof. As shown in FIG. 1, the disclosed embodiment includes two larger, ten-person living units 63 and four smaller, six-person living units 64. One larger living unit 63 and two smaller living units 64 are located on each side of the utility core 60.

The living units 63, 64 include table assemblies 67 with attached bench seating 68, bed assemblies 69 with relatively low (e.g. thirty-six inches to forty-two inches high) L-shaped privacy walls 70, shower stalls 71, sink and toilet fixtures 72, lockers 73 and telephones 74. Shower bases 75 can be recessed into the floor structure 27 in the shower stalls 71 (e.g. by cutting openings in a concrete slab of the floor structure 27) and can provide drainage for surrounding areas of the residential unit 11.

Utility core walls 77 and living unit dividing walls 78 all extend to a height of approximately ten feet and provide a measure of privacy between the respective living units 63, 64. Each living unit 63, 64 also includes at least one mesh wall 79 comprising a chain link mesh, e.g. six gauge wire woven in a two-inch-by-two-inch mesh pattern. Mesh ceilings 82 cover the living units 63, 64 and may comprise a similar mesh material to that used for the mesh walls 79. The mesh walls and ceilings 79, 82 are supported by a living unit framework 85 including columns 86 and beams 87. As shown in FIG. 5, the mesh ceilings 82 can be attached to the framework 85 by welding nuts 83 onto the beams 87 for receiving bolts 84 which retain the mesh ceilings 82 with flat washers 89 and split washers 90.

The mesh walls and ceilings 79, 82 can include suitable pipes, cross bracing and connectors as required to enclose the living units 63, 64.

Figure 4:
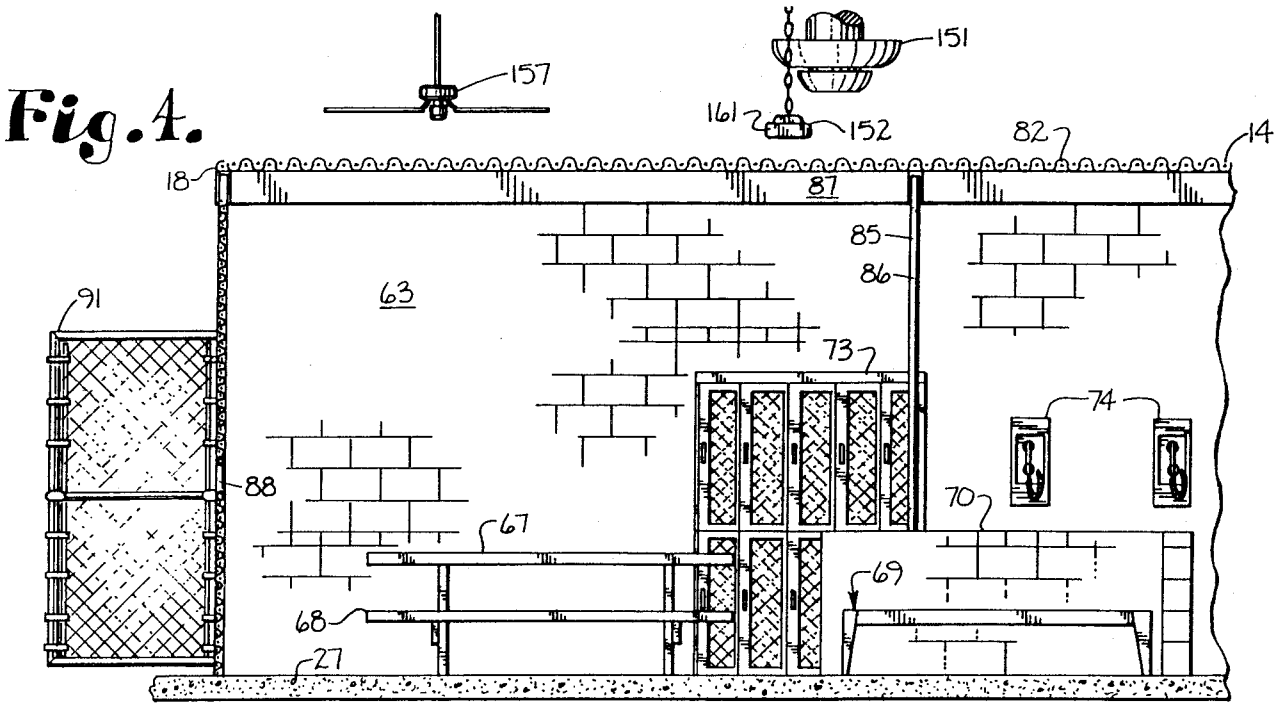
FIG. 4 is an enlarged, fragmentary, vertical cross-sectional of the facility taken generally along line 4—4 in FIG. 1.
Figure 6:
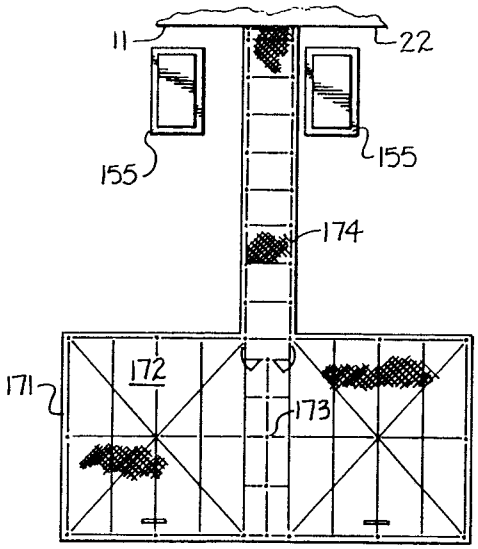
FIG. 6 is an enlarged, fragmentary, top plan view of the facility, particularly showing an exterior exercise enclosure.

A layer of clear plastic sheathing 65 can be fastened to the mesh living and cell unit ceilings from underneath to prevent access to the mesh by inmates (FIG. 5). As shown in FIG. 4, pass-through openings 88 can be provided in the mesh wall 79 for meal service and for passing various other objects and materials. Security gates 91 are provided in the wall 79 for ingress and egress to the living units 63, 64. The gates 91 are preferably provided with appropriate security devices, which can include locks, alarms, etc. A catwalk 92 is provided over the utility core 60 and is accessible by a stairway 93. From the catwalk 92 every living unit 63, 64 can be observed through the mesh ceilings 82 thereof.

IV. Cell Block Envelope 15

Figure 3:
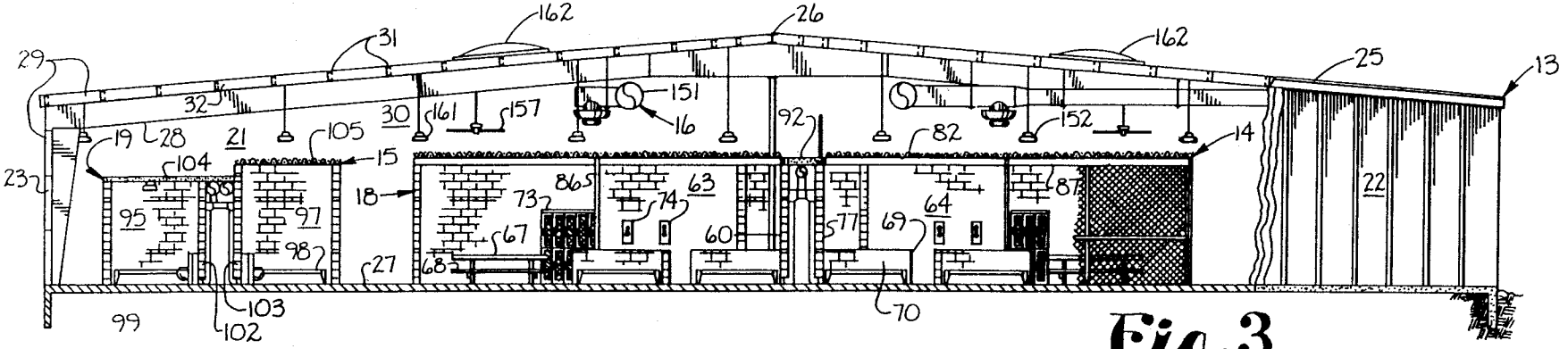
FIG. 3 is a transverse, cross-sectional view of the facility generally along line 3—3 in FIG. 1.

The cell block envelope 15 encloses a cell block 96 comprising an outer column of five cell units 95 and an inner column of five cell units 97 each containing a bed 98 and plumbing (e.g. toilet and sink) facilities 72. The cell block 96 includes a central, longitudinally-extending utility core 102 with utility core walls 103. The utility core 102 is accessible through interior doors 44. The cell units 95 and 97 are arranged on each side of the utility core 102 and project transversely outwardly therefrom. The cell block 96 can provide for varying degrees of privacy. As shown in FIG. 3, a slab 104 is placed over the top of the utility core 102 and the outer column of cell units 95. The interior column of five cell units 97 includes a mesh ceiling 105. The cell units 95, 97 include suitable interior doors 44. Front and back corridors 108, 109 are provided along the front and back walls 21, 22 respectively and are innerconnected by first and second longitudinal corridors 111, 112. Longitudinal and transverse corridors 114, 115 provide access to the outer column of cell units 95.

V. Administrative Unit 12

The administrative unit 12 is continguous with the residential unit 11 along a portion of the front wall 21 and can include appropriate offices and rooms to provide for the administrative requirements and functions of the detention facility 10. Without limitation on the generality of useful configurations for the administrative unit 12, it can include: a waiting room 121; a secretarial and record room 122; a jail commander's office 123; a chief deputy's and/or captain's office 124; a dietician's office 125; a squad room 126; a commissary 127; a telephone and radio equipment room 128; a storeroom 129; a nurse and examination room 130; a security vestibule 131; a control and dispatch station 132; toilets 133, 134, 135 and 136; a contact and visiting room 137; a visiting room 138 separated from the front corridor 108 by a screen wall 139; and a conference and interview room 140. Ingress and egress to and from the administration unit 12 is through an exterior door 43 to the waiting room 121. Another exterior door 43 is provided on the other side of the administration unit 12.

VI. Environmental Systems 16

The relatively open configuration of the residential unit 11 facilitates efficient environmental control. The environmental control system 16 generally comprises a heating, ventilating and air-conditioning (i.e. HVAC) subsystem 151 and a lighting subsystem 152.

The HVAC subsystem 151 can include suitable heating and cooling units 155 mounted behind the back wall 22. An air distribution duct network 156 is provided within the residential unit 11 and is connected to the heating and cooling units 155. As shown in FIG. 3, the duct network 156 is primarily located in areas that are not accessible to the inmates, i.e. above the living unit block 65, the support facility blocks 33, 48 and the cell block 96; and within the utility cores 60 and 102. Suitable ventilation is provided, and the kitchen 50 can include HVAC equipment for its particular requirements. Reversible, multi-speed ceiling fans 157 can be provided over the mesh-roofed portions of the residential unit 11 for air distribution. Plastic-coated insulation 32 can be placed between purlins 31 of the roof structure 25.

The lighting subsystem 152 can include fluorescent units 161 mounted above the mesh-roofed areas of the residential unit 11 and skylights 162, e.g. transparent or transluscent panels, can be provided in the roof structure 25.

It will be appreciated that the relatively open configuration of the residential unit 11 with its extensive use of mesh material cooperates with the environmental control system 16 to provide several important advantages. Since the mesh material transmits both air and light, the environmental control system 16 can be substantially located outside of the dormitory envelope 14 and the cell block envelope 15. The costs of the environmental control system components can thus be greatly reduced compared with such components which are designed for installations where they are accessible to inmates and hence must be tamper-resistant.

Furthermore, placing such environmental control system components relatively high within the interior volume 30 facilitates the distribution of light and air over large areas. In this manner, the fluorescent lighting 161 can be augmented by the skylights 162, thereby providing a well-lit environment while minimizing electricity usage. The relatively large, high-ceilinged interior volume 30 of the residential unit 11 also tends to provide a feeling of spaciousness.)

VII. External Exercise Enclosure 17

The external exercise enclosure 17 comprises mesh walls 171 and a mesh roof 172 and can be constructed with a suitable framework 173 for mounting mesh, which can be similar to the residential unit framework 85. A tunnel-like mesh accessway 174 connects the exercise enclosure 17 with the exterior door 43 in the residential unit back wall 22.

VIII. Operation

In operation, the detention facility 10 is designed to provide for the efficient detention of inmates with provisions for both group living units of different sizes and individual cells. It will be appreciated that the mix of individual cells and group living units of different sizes can vary to accommodate the requirements in particular situations. Furthermore, the mix can be relatively easily adjusted even after a facility is constructed, for example by subdividing or combining some of the group living units. Additional inmate capacity can be achieved by placing additional beds above those shown.

Security features can be incorporated in the facility 10 as necessary to implement security procedures deemed most appropriate by the officials responsible for its operation. Such features would typically include providing electric locks on doors which can be controlled from a central location, e.g. the control and dispatch room 132; providing procedures to deal with various emergencies; providing visitation procedures;

and controlling the transfer of inmates into, out of, and within the facility 10. For example, the vehicular sally port 35 can function as the primary means of ingress and egress to the facility 10 for inmates who are transported by vehicles. The security system in the sally port 35 can provide for only one of its doors being open at a particular time, so that persons already within the facility 10 could not escape through the sally port 35 when another inmate arrives or leaves. The security vestibule 131 can function as the primary means of ingress and egress by the detention facility officials, guards, employees and visitors between the residential and administration units 11, 12. The doors 44 to the security vestibule 131 can be electrically controlled so that only one is open at a time for security purposes.

The exterior exercise enclosure 17 not only provides a facility for outdoor inmate exercise, it also provides a safe refuge in the event of a fire within the residential unit 11.

The mesh living unit walls 79 can comprise galvanized or aluminum mesh for corrosion resistence. The mesh ceilings 82 can comprise plastic-coated mesh, which can be black or a similar dark color to reduce glare whereby the view of the skylights 162 from within the living units 63, 64 and the inner cell units 97 is enhanced. Also, by thus reducing glare from the mesh ceilings 82, the living unit and cell unit interiors can be more easily observed from the catwalks above. The treads of the stairway 93 and the catwalk 92 can be carpeted to facilitate clandestine surveillance. Also, since the living units 63 are visually screened from the front corridor 108 by solid walls, guards can enter and leave the residential unit 11 without being observed by the inmates.

Providing appropriate residential accommodations for inmates under various circumstances is facilitated by the configuration of the detention facility 10. Thus, the general population can be detained within the living units 63, 64. Individuals can be separately detained in the cell units 95, 97. For example, it may be desirable to separately and individually detain inmates who are ill, suicide-prone, unruly, transient and juveniles. The individual cell units 95 and 97 can also be used for disciplinary isolation. Furthermore, separation by sex can be accomplished with the configuration of the detention facility 10, while still providing visual privacy between male and female inmates.

The relatively large and open interior volume 30 tends to absorb sounds, and the relatively light construction of the living unit gates 91 tends to make them relatively quiet in operation. The solid interior walls in the residential unit 11 can be constructed of relatively economical masonry blocks, which can be left unpainted (except where paint might be necessary for moisture protection, e.g. in the shower stalls 71) to absorb sound for noise control.

It is to be understood that while certain forms of the present invention have been illustrated and described herein, it is not to be limited to the specific forms or arrangement of parts described and shown.

I claim:

1. A structure for detaining inmates, which comprises:

(a) outer, weather envelope means enclosing a relatively weather-tight interior volume;

(b) interior detention envelope means enclosing a detention space and adapted to pass light and air;

(c) environmental control means positioned between said weather and detention envelopes;

(d) a walkway on top of said detention envelope means; and (e) observation means associated with said detention envelope means for permitting observation of said detention space from said walkway.

2. The structure according to claim 1 wherein:

(a) said enclosure means includes a mesh material.

3. The structure according to claim 2 wherein:

(a) said mesh material forms sides and a top of said detention envelope means.

4. The structure according to claim 1 wherein:

(a) said detention space is subdivided into a plurality of discreet living units.

5. The structure according to claim 4, which includes:

(a) a utility core positioned between and separating a pair of said living units.

6. The structure according to claim 5, which includes:

(a) said detention space comprising a block of multiple-inmate living units; and (b) a cell block including a plurality of individual cell units.

7. The structure according to claim 1 wherein:

(a) said environmental control means includes a heating, ventilating and air-conditioning subsystem with air-handling ducts positioned at least partly between said weather envelope and said detention envelope.

8. The structure according to claim 1 wherein:

(a) said environmental control means includes a lighting subsystem positioned at least partly between said weather and said detention envelopes.

9. The structure according to claim 1, which includes:

(a) a residential unit containing said detention space; and (b) an administrative unit connected to said residential unit.

10. In combination with an industrial-type building including an outer, weather envelope with front, back and opposite side walls, a floor structure and a roof structure, the improvement of a detention facility, which includes:

(a) a living unit block including:

(1) a pair of living units each having an interior;

(2) a utility core extending between said living units;

(3) a pair of mesh material detention walls each comprising an exterior wall of a respective living unit; and (4) a mesh ceiling on top of said living units; and (b) an environmental control system positioned between said weather envelope and said living unit block and including an air-handling duct network in air exchange relationship wit the interiors of said living units and a lighting system including electrical lighting fixtures.

11. The structure according to claim 10, which includes:

(a) a platform on top of said utility core.

12. The structure according to claim 11, which includes:

(a) a stairway extending from said floor structure to said platform.

13. The structure according to claim 12 wherein:

(a) said stairway and said platform are carpeted.

14. The structure according to claim 1 wherein:

(a) each said living unit includes multiple beds.

15. The structure according to claim 14 wherein:

(a) each said living unit includes:

(1) shower means; and (2) toilet means

16. The structure according to claim 1, which includes:

(a) a cell block having a plurality of individual cell units positioned in a pair of aligned columns.

17. The structure according to claim 16 wherein:

(a) at least one of said cell unit columns includes a mesh roof.

18. The structure according to claim 16, which includes:

(a) a corridor between said living unit and said cell block; and (b) a vehicular access facility within said enclosure, said vehicular access facility being adapted to receive a vehicle and providing controlled access to said corridor.

19. The structure according to claim 1, which includes:

(a) an external mesh material enclosure including a passageway connected to said corridor.

20. In combination with an industrial-type building including a relatively large main unit having a sloping roof peaking at a longitudinally-extending, central ridge line and a relatively small secondary unit connected to the main unit, the improvement of a detention facility, which includes:

(a) a residential unit positioned within said main unit and including:

(1) a central living unit block with a utility core extending longitudinally under said ridge roof line, a pair of living units each positioned on a respective side of said core, exterior, mesh material walls and mesh material ceilings partially enclosing said living units, a plurality of beds in each living unit, and a walkway on top of said utility core above the level of said mesh ceilings;

(2) a cell block including inner and outer longitudinally-aligned columns of cell units each having a plurality of cell units and said inner column having a mesh roof;

(3) controlled access means including lockable vehicular and pedestrian access doors;

(b) a heating, ventilating and air-conditioning system including a duct network positioned at least partly between said living unit block ceiling and said structure roof in an air-exchanging relationship with said living units;

(c) a lighting subsystem including a plurality of light fixtures positioned between said living unit block ceiling and said roof structure; and (d) a plurality of skylights in said roof structure over said living unit block.

21. The structure according to claim 20, which includes:

(a) said mesh forming said living unit walls being galvanized.

22. The structure according to claim 20, which includes:

(a) said mesh comprising said living unit block ceilings being coated with plastic having a relatively dark color.

23. A structure for detaining inmates, which comprises:

(a) an outer, weather envelope including front, back and opposite side walls, a floor structure and a roof structure; and (b) a living unit block including:

(1) a pair of living units each having multiple beds, shower means and toilet means;

(2) a utility core extending between said living units;

(3) a pair of mesh material detention walls each comprising an exterior wall of a respective living unit; and (4) a mesh ceiling on top of said living units; and (c) an environmental control system positioned between said weather envelope and said living unit block and including an air-handling duct network in air exchange relationship with the interiors of said living units.

24. A structure for detaining inmates, which comprises:

(a) outer, weather envelope means enclosing a relatively weather-tight interior volume;

(b) interior detention envelope means enclosing a detention space and adapted to pass light and air;

(c) environmental control means positioned between said weather and detention envelopes;

(d) a walkway on top of said detention envelope means; and (e) said detention envelope means including sides and a top formed of a mesh material.

* * * * *